US010024179B2

(12) United States Patent
Congratel et al.

(10) Patent No.: US 10,024,179 B2
(45) Date of Patent: Jul. 17, 2018

(54) FIXED DIFFUSER VANES ASSEMBLY FOR GUIDING FLOW THROUGH A TURBOMACHINE, COMPRISING AN INTERNAL PLATFORM WITH INBUILT REINFORCEMENTS, AND ASSOCIATED TURBOMACHINE AND PRODUCTION METHOD

(71) Applicant: SNECMA, Paris (FR)

(72) Inventors: Sebastien Congratel, Moissy-Cramayel (FR); Marion Chambre, Moissy-Cramayel (FR); Bruno Richard, Moissy-Cramayel (FR); Romain Roullet, Moissy-Cramayel (FR)

(73) Assignee: SNECMA, Paris (FR)

( * ) Notice: Subject to any disclaimer, the term of this patent is extended or adjusted under 35 U.S.C. 154(b) by 429 days.

(21) Appl. No.: 14/762,782

(22) PCT Filed: Jan. 22, 2014

(86) PCT No.: PCT/FR2014/050113

§ 371 (c)(1),
(2) Date: Jul. 22, 2015

(87) PCT Pub. No.: WO2014/114873

PCT Pub. Date: Jul. 31, 2014

(65) Prior Publication Data

US 2015/0377044 A1 Dec. 31, 2015

(30) Foreign Application Priority Data

Jan. 23, 2013 (FR) ..... 13 50582

(51) Int. Cl.
*F01D 9/02* (2006.01)
*F01D 11/00* (2006.01)

(52) U.S. Cl.
CPC ..... *F01D 9/02* (2013.01); *F01D 11/001* (2013.01); *F05D 2230/237* (2013.01); *F05D 2240/80* (2013.01)

(58) Field of Classification Search
CPC . F01D 9/02; F01D 11/001; F01D 9/04; F05D 2240/80; F05D 2230/237
(Continued)

(56) References Cited

U.S. PATENT DOCUMENTS 4,767,267 A * 8/1988 Salt ..... F01D 11/001 415/173.7
2011/0052380 A1* 3/2011 Bariaud ..... F01D 9/041 415/182.1

FOREIGN PATENT DOCUMENTS

| | | |
|---|---|---|
| FR | 2930592 | 10/2009 |
| GB | 807231 | 1/1959 |
| GB | 2198489 | 6/1988 |

OTHER PUBLICATIONS

International Search Report and Written Opinion with English Language Translation, dated Jun. 23, 2014, Application No. PCT/FR2014/050113.

(Continued)

*Primary Examiner* — Richard Edgar
*Assistant Examiner* — Michael Sehn
(74) *Attorney, Agent, or Firm* — Womble Bond Dickinson (US) LLP

(57) ABSTRACT

The invention relates to a fixed diffuser vanes assembly (10) for guiding flow through a turbomachine, comprising an internal annular platform (12) and a plurality of fixed vanes (11) which are mounted on this platform, the internal platform comprising a support plate (121) forming the base of said vanes, a radial annular partition (120) extending from the support plate toward an axis of the vanes assembly, and an internal ring (122) attached to the radial annular partition (Continued)

and having an internal surface on which an abradable material (123) is arranged, the vanes assembly being characterized in that the internal ring comprises at least one cut-out (1223) delimiting a tongue (1226), the tongue being bent to press against the radial annular partition (120). The invention also relates to a method of manufacturing such a vanes assembly and to a turbomachine incorporating such vanes.

11 Claims, 2 Drawing Sheets

(58) Field of Classification Search
USPC ..... 415/173.4
See application file for complete search history.

(56) References Cited

OTHER PUBLICATIONS

French Search Report and Written Opinion, dated Jul. 11, 2013, French Application No. 1350582.

* cited by examiner

FIXED DIFFUSER VANES ASSEMBLY FOR GUIDING FLOW THROUGH A TURBOMACHINE, COMPRISING AN INTERNAL PLATFORM WITH INBUILT REINFORCEMENTS, AND ASSOCIATED TURBOMACHINE AND PRODUCTION METHOD

FIELD OF THE INVENTION

The field of the invention is that of fixed vanes for distributing the air flow in a turbomachine.

PRIOR ART

A turbomachine generally includes, from upstream to downstream in the gas flow direction, a fan, one or more compressor stages, for example a low pressure compressor and a high pressure compressor, a combustion chamber, one or more turbine stages, for example a high pressure turbine and a low pressure turbine, and a gas exhaust duct.

These turbines include an air flow distributor within the turbomachine, consisting of a plurality of stages of fixed vanes each having a plurality of vanes extending generally radially with respect to the axis of the turbomachine, and positioned between an inner annular platform and an outer annular platform by which said vanes are attached to the turbomachine.

In order particularly to minimize the overall mass of the engine, all or part of these vanes are hollow.

To make these different cavities which have complex shapes, and the geometry whereof must be followed with high accuracy, the vanes are conventionally produced by a technique known as lost wax casting. Cores are therefore inserted into the mold prior to injecting the wax, these cores being held in position by sockets, the association between the sockets and the cores being accomplished manually.

However, the current geometry of vanes does not allow sufficient space to allow the sockets to be positioned, and consequently to achieve hollow vanes with a given tolerance and dimensions.

In this regard, a fixed vane assembly has been proposed of which the inner annular platform includes an annular support plate forming the base of the vanes and a radial partition extending from said plate toward the axis of the turbomachine, said radial partition being associated with an inner ring having an outer surface at which said ring is attached to the radial partition, the ring and the radial partition also being attached to one another by reinforcing elements.

But to reduce the mass of the turbomachine it is necessary to reduce the number of parts.

PRESENTATION OF THE INVENTION

The invention aims to correct this set of problems, by proposing a fixed vane assembly for distributing flow within a turbomachine, including an inner annular platform and a plurality of fixed vanes mounted thereon, the inner platform including a support plate forming the base of said vanes, an annular radial partition extending from the support plate toward an axis of the vane assembly, and an inner ring applied to the radial annular partition and having an inner surface on which is positioned an abradable material, the vane assembly being characterized in that the inner ring comprises at least one cut delimiting a tongue, the tongue being folded so as to bear on the radial annular partition.

Advantageously but optionally, the vane assembly according to the invention can further include at least one of the following features:

- the or each tongue bears against, with at least one end portion, on the radial partition, which makes it possible to make only one fold of the tongue and thus to simplify the manufacture of the vane assembly.
- If the vane assembly has several tongues, these can be positioned in a regular angular distribution on the circumference of the ring, so as to distribute in a balanced manner the abutting contacts and thus confer better stability to the vane assembly.
- the end portion of each tongue is brazed onto the radial partition.
- the inner ring is applied to the radial annular partition at the through openings each resulting from the folding of a corresponding tongue.
- the abradable material is applied to the radial partition through each opening.
- The abradable material is brazed to the inner surface of the ring, and to the radial partition through each opening of the ring.
- the inner ring also includes an annular tab extending upstream and an annular tab extending downstream with respect to an air flow in the vane assembly.

The invention also proposes a turbomachine comprising at least one such vane assembly.

The invention also proposes a manufacturing method for a fixed vane assembly according to the invention, including steps consisting of:

- forming at least one U-shaped cut in one ring to delimit a plurality of tongues,
- folding a portion of the right-angled tongue with respect to the ring, and
- attaching the ring to the radial partition of an inner annular platform of vane assembly, so that the radial partition is in contact with an outer annular surface of the ring, and the portion of the right-angled tongue with respect to the ring bears on said partition.

Advantageously but optionally, the method according to the invention can further include at least one of the following features:

- the step consisting of attaching the ring to the radial partition includes brazing the portion of each right-angled tongue with respect to the ring onto the partition.
- The method also includes a step consisting of brazing a layer of abradable material onto an inner surface of the ring and onto the radial partition through a plurality of openings of the ring resulting from the folding of each tongue.

Thus, the distribution vane assembly according to the invention is lighter, but just as robust as before because the function of reinforcement supporting the radial partition is accomplished by the inner ring of the vane assembly itself, but without adding material.

DESCRIPTION OF THE FIGURES

Other features, goals and advantages of the invention will be revealed by the description hereafter, which is purely illustrative and not limiting, and which must be read with reference to the appended drawings, wherein.

DETAILED DESCRIPTION OF AT LEAST ONE EMBODIMENT

Figure 1:
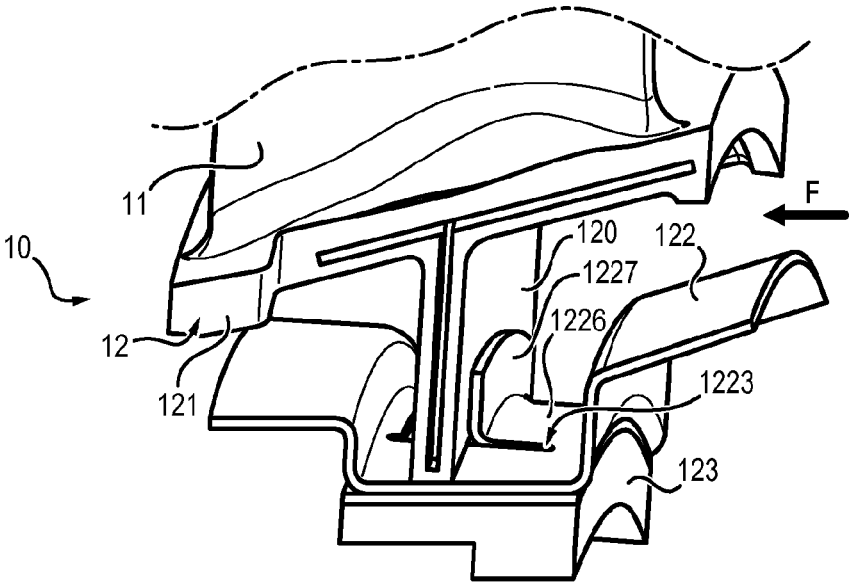
FIG. 1 shows a partial section view of a set of flow distribution vanes according to one embodiment of the invention.

Referring to FIG. 1, a partial view of a fixed vane assembly 10 for distributing the flow of air in a turbomachine is shown, the direction of flow of the air stream being shown by an arrow F, the vane assembly forming one stage of a nozzle of a turbomachine's turbine, for example of a low pressure turbine.

The vane assembly 10 comprises a plurality of fixed vanes 11 arranged radially with respect to an axis of the turbomachine (not shown), which is also the axis of the vane assembly, said vanes being mounted on an inner annular platform 12.

The platform 12 comprises an annular partition 120 extending radially with respect to the axis of the turbomachine, as well as an annular plate 121 for supporting the vanes 11, extending on either side of the annular partition at one external radial end thereof.

The platform 12 also comprises an inner ring 122, extending on either side of the radial annular partition 120 at its radially inner end, and on which is applied a layer of abradable material 123.

Figure 2A:
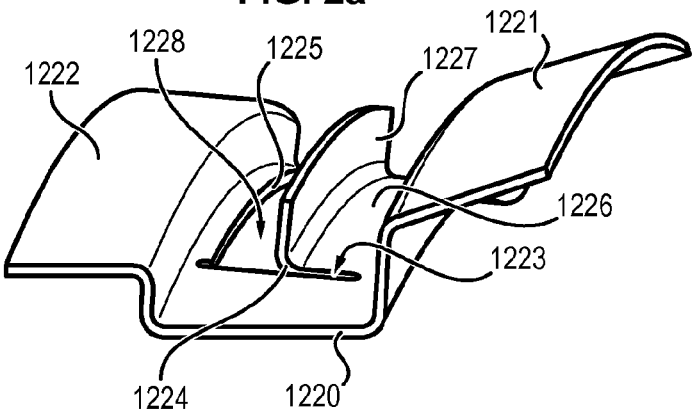
FIGS. 2*a* and 2*b* show respectively a partial section view and a top view of an inner ring of the inner annular platform of a set of flow distribution vanes of FIG. 1.
Figure 2B:
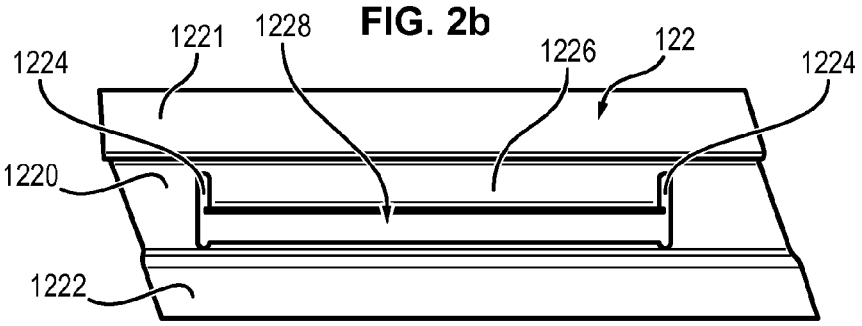

With reference to FIGS. 2*a* and 2*b*, the inner ring 122 has a median annular section 1220 extending substantially axially with respect to the axis of the vane assembly, and two annular end tabs 1221, 1222 extending respectively upstream and downstream of the vane assembly with respect to the air flow, being offset radially with respect to the median section 1220, said sections possibly being inclined with respect to the axis of the vane assembly.

These sections are formed to cooperate with the rotor blade spoilers placed upstream and downstream with respect to the vane assembly 10, so as to form labyrinth type seals to avoid recirculation of air in a radial direction between the jet of the vane assembly 10 (that is between the vanes 11) and the interstice between the platform of the fixed vanes and the adjoining rotor.

In addition, the inner ring 122 includes, in its median section 1220, at least one, and preferably a plurality of U-shaped cuts 1223, each cut thus including two portions 1224, preferably but non restrictively parallel (forming the branches of the "U") united at one end by a transverse portion 1225 (forming the base of the "U"). Advantageously, as in FIG. 2*a*, the portions 1224 are oriented substantially parallel to the axis of the vane assembly and the transverse portion 1225 and positioned on the downstream side of the cut with respect to the air flow.

Each cut 1223 thus delimits a tongue 1226 detached from the rest of the median section by the three portions of the cut. Due to the shape of the cuts, each tongue extends over an annular sector.

At least one end portion 1227 of each cut is folded at a right angle with respect to the median section of the ring 122 so as to extend substantially radially.

The totality of each tongue can also be folded at a right angle with respect to the ring.

Each tongue thus folded frees an annular, sector-shaped opening 1228 in the ring 122.

Preferably, the cuts 1223, and hence the tongues 1226 and the openings 1228, are regularly distributed, that is at a constant angular interval with respect to the axis of the vane assembly, along the circumference of the ring. Thus, the ring 122 has, in one annular area of its median section of the width of the openings, an alternation of solid areas and openings 1228.

Finally, the ring 122 is applied to the radial partition 120 at the annular area including the alternation of openings and solid areas, the end 1227 of the right angled tongues with respect to the ring bearing against the radial partition.

In this manner, the tongues cut from the ring constitute the surface to be brazed onto the radial partition, thus making it possible to ensure assembly of the ring to the radial partition without adding supplementary elements (for example sheet metal elements, tabs on the radial partition . . . ). The vane assembly is therefore lightened.

On the other hand, the layer of abradable material 123 applied to the ring can therefore also be applied to the radial partition through each opening 1228 in said ring. Preferably, the layer of abradable material 123 is brazed on the one hand to the radial partition through each opening, and on the other hand to the radially inner surface of the median section 1220 of the inner ring.

The ring 122 may include only one U-shaped cut 1223, it thus occupies a smaller space. Other types of attachment can nevertheless be integrated with the ring, complementing said single cut.

Figure 3:
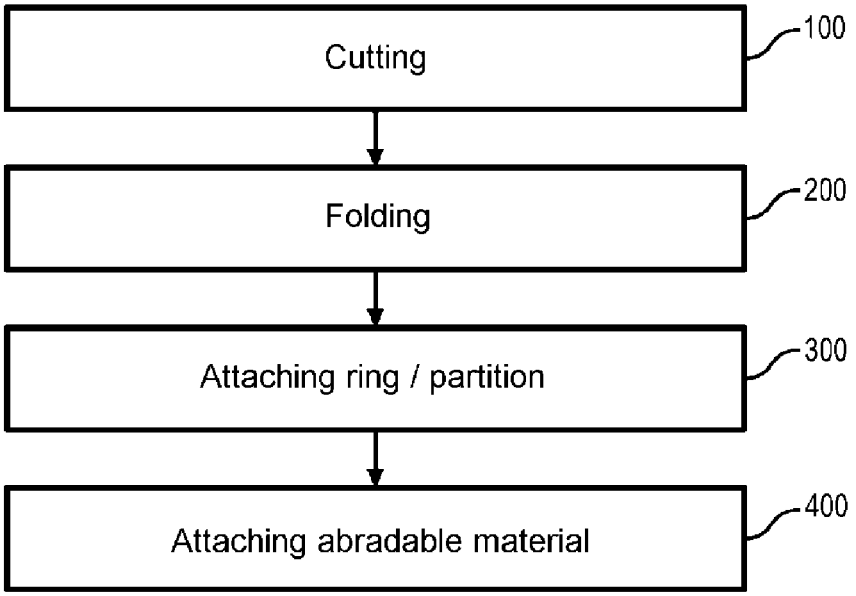
FIG. 3 shows schematically the principal steps of the manufacturing method for a set of flow distributing vanes according to one embodiment of the invention.

We will now describe, with reference to FIG. 3, a method for manufacturing the vane assembly described above.

During a step 100, a plurality of U-shaped cuts 1223 are made on the circumference of an annular ring 122, conforming to the cuts described above, the cuts preferably being distributed regularly on said circumference.

During a step 200, the tongue 1226 delimited by each right-angled cut 1223 toward the outside of the ring is folded, so that the end 1227 of each tongue is oriented substantially radially with respect to the axis of the ring.

During a step 300, the ring 122 is applied to the radial partition 120 of an inner platform of a fixed vane assembly, the vanes 11 and the outer platform of the vane assembly also possibly being already mounted on the inner platform. The ring is applied in such a way that the folded ends of each tongue bear against the radial partition, and the radial annular partition is positioned at the openings 1228 made in the ring.

Preferably, the ends of the tongues 1226 bearing against the radial partition, as well as the areas of the ring between two consecutive openings, are brazed to the radial partition.

Finally, during a step 400, a layer of abradable material 123 is applied to the assembly obtained in the previous step, preferably by brazing the layer to the radially inner surface of the median portion 1220 of the ring and, at the openings 1228, by brazing the layer 123 to the radial partition (also on its radially inner surface).

Advantageously, but optionally, the brazing operations 300 and 400 can be carried out simultaneously, which makes the method quicker to implement.

The invention claimed is:

1. A fixed vane assembly for distributing flow within a turbomachine, including an inner annular platform and a plurality of fixed vanes mounted thereon, the inner annular platform including a support plate forming the base of said vanes, an annular radial partition extending from the support plate toward an axis of the vane assembly, and an inner ring applied to the radial partition and having an inner surface on which is positioned an abradable material, wherein the inner ring includes at least one cut delimiting a tongue, the tongue being folded to bear against the radial partition.

2. The vane assembly according to claim 1, wherein the tongue bears, with at least one end portion, on the radial partition.

3. The vane assembly according to claim 2, wherein the at least one end portion is brazed onto the radial partition.

4. The vane assembly according to claim 1, wherein the inner ring is applied to the radial partition at through openings each resulting from folding the corresponding tongue.

5. The vane assembly according to claim 4, wherein the abradable material is applied to the radial partition through each opening.

6. The vane assembly according to claim 4, wherein the abradable material is brazed to the inner surface of the ring and to the radial partition through each opening of the ring.

7. The vane assembly according to claim 1, wherein the inner ring further includes an annular tab extending upstream and an annular tab extending downstream with respect to an air flow in the vane assembly.

8. A turbomachine including at least one fixed vane assembly for distributing flow according to claim 1.

9. A method for manufacturing a fixed vane assembly for distributing flow according to claim 1, including the steps of:

forming at said least one cut in said inner ring to delimit said tongue, folding one portion of the tongue with respect to the inner ring, and attaching the inner ring to the radial partition of the inner annular platform of vane assembly, so that the radial partition is in contact with an outer annular surface of the inner ring, and the portion of the tongue with respect to the ring bears on said partition.

10. The method for manufacturing a vane assembly according to claim 9, wherein attaching the inner ring to the radial partition includes brazing the portion of the tongue with respect to the inner ring onto the partition.

11. The method for manufacturing a vane assembly according to claim 9, further including brazing a layer of abradable material onto the inner surface of the ring, and onto the radial partition through a plurality of openings of the inner ring resulting from the folding of the tongue.

* * * * *